US007519535B2

(12) United States Patent
Spindola

(10) Patent No.: US 7,519,535 B2
(45) Date of Patent: Apr. 14, 2009

(54) FRAME ERASURE CONCEALMENT IN VOICE COMMUNICATIONS

(75) Inventor: Serafin Diaz Spindola, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 632 days.

(21) Appl. No.: 11/047,884

(22) Filed: Jan. 31, 2005

(65) Prior Publication Data

US 2006/0173687 A1 Aug. 3, 2006

(51) Int. Cl.
*G10L 19/00* (2006.01)

(52) U.S. Cl. ..... 704/266; 704/265

(58) Field of Classification Search ..... 704/266, 704/265

See application file for complete search history.

(56) References Cited

U.S. PATENT DOCUMENTS 5,699,478 A * 12/1997 Nahumi ..... 704/226
5,907,822 A * 5/1999 Prieto, Jr. ..... 704/202
6,205,130 B1 * 3/2001 DeJaco ..... 370/335
6,597,961 B1 * 7/2003 Cooke ..... 700/94
6,952,668 B1 * 10/2005 Kapilow ..... 704/206
7,027,989 B1 * 4/2006 Tapadar et al. ..... 704/207
7,233,897 B2 * 6/2007 Kapilow ..... 704/229

OTHER PUBLICATIONS

Frank Mertz, et al. "*Voicing Controlled Frame Loss Concealment for Adaptive Multi-Rate (AMR) Speech Frames in Voice-over-IP*", Eurospeech 2003-Geneva, Sep. 2003, pp. 1077-1080.
Tammi, M, et al., Signal Modification for Voiced Wideband Speech Coding and its Application for IS-95 System, Speech Coding 2002, IEEE Workshop Proceedings Oct. 6-9, 2002, pp. 35-37.
Wang, J., et al., *Parameter Interpolation to Enhance the Frame Erasure Robustness of CELP Coders in Packet Networks*, 2001 IEEE International Conference on Acoustics, Speech, and Signal Processing.Proceedings, vol. 1, May 7, 2001, pp. 745-748.
Ray, D. E. et al., "*Reed-Solomon Coding for CELP EDAC in Land Mobile Radio*", 1994 IEEE International Conference on Adelaide, SA, Australia, vol. I, Apr. 19, 1994, pp. I-285.
De Martin J.C., et al., "*Improved Frame Erasure Concealment for CELP-Based Coders*", 2000 IEEE International Conference, vol. 3, Jun. 5, 2000, pp. 1483-1486.
International Search Report dated Jun. 29, 2006 (5 pages).

* cited by examiner

*Primary Examiner*—Susan McFadden
(74) *Attorney, Agent, or Firm*—Thomas R. Rouse

(57) ABSTRACT

A voice decoder configured to receive a sequence of frames, each of the frames having voice parameters. The voice decoder includes a speech generator that generates speech from the voice parameters. A frame erasure concealment module is configured to reconstruct the voice parameters for a frame erasure in the sequence of frames from the voice parameters in one of the previous frames and the voice parameters in one of the subsequent frames.

49 Claims, 4 Drawing Sheets

FRAME ERASURE CONCEALMENT IN VOICE COMMUNICATIONS

BACKGROUND

1. Field

The present disclosure relates generally to voice communications, and more particularly, to frame erasure concealment techniques for voice communications.

2. Background

Traditionally, digital voice communications have been performed over circuit-switched networks. A circuit-switched network is a network in which a physical path is established between two terminals for the duration of a call. In circuit-switched applications, a transmitting terminal sends a sequence of packets containing voice information over the physical path to the receiving terminal. The receiving terminal uses the voice information contained in the packets to synthesize speech. If a packet is lost in transit, the receiving terminal may attempt to conceal the lost information. This may be achieved by reconstructing the voice information contained in the lost packet from the information in the previously received packets.

Recent advances in technology have paved the way for digital voice communications over packet-switched networks. A packet-switch network is a network in which the packets are routed through the network based on a destination address. With packet-switched communications, routers determine a path for each packet individually, sending it down any available path to reach its destination. As a result, the packets do not arrive at the receiving terminal at the same time or in the same order. A jitter buffer may be used in the receiving terminal to put the packets back in order and play them out in a continuous sequential fashion.

SUMMARY

The existence of the jitter buffer presents a unique opportunity to improve the quality of reconstructed voice information for lost packets. Since the jitter buffer stores the packets received by the receiving terminal before they are played out, voice information may be reconstructed for a lost packet from the information in packets that precede and follow the lost packet in the play out sequence.

A voice decoder is disclosed. The voice decoder includes a speech generator configured to receive a sequence of frames, each of the frames having voice parameters, and generate speech from the voice parameters. The voice decoder also includes a frame erasure concealment module configured to reconstruct the voice parameters for a frame erasure in the sequence of frames from the voice parameters in one of the previous frames and the voice parameters in one of the subsequent frames.

A method of decoding voice is disclosed. The method includes receiving a sequence of frames, each of the frames having voice parameters, reconstructing the voice parameters for a frame erasure in the sequence of frames from the voice parameters in one of the previous frames and the voice parameters from one of the subsequent frames, and generating speech from the voice parameters in the sequence of frames.

A voice decoder configured to receive a sequence of frames is disclosed. Each of the frames includes voice parameters. The voice decoder includes means for generating speech from the voice parameters, and means for reconstructing the voice parameters for a frame erasure in the sequence of frames from the voice parameters in one of the previous frames and the voice parameters in one of the subsequent frames.

A communications terminal is also disclosed. The communications terminal includes a receiver and a voice decoder configured to receive a sequence of frames from the receiver, each of the frames having voice parameters. The voice decoder includes a speech generator configured to generate speech from the voice parameters, and a frame erasure concealment module configured to reconstruct the voice parameters for a frame erasure in the sequence of frames from the voice parameters in one of the previous frames and the voice parameters in one of the subsequent frames.

It is understood that other embodiments of the present invention will become readily apparent to those skilled in the art from the following detailed description, wherein various embodiments of the invention are shown and described by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWINGS

Aspects of the present invention are illustrated by way of example, and not by way of limitation, in the accompanying drawings, wherein.

DETAILED DESCRIPTION

The detailed description set forth below in connection with the appended drawings is intended as a description of various embodiments of the present invention and is not intended to represent the only embodiments in which the present invention may be practiced. The detailed description includes specific details for the purpose of providing a thorough understanding of the present invention. However, it will be apparent to those skilled in the art that the present invention may be practiced without these specific details. In some instances, well known structures and components are shown in block diagram form in order to avoid obscuring the concepts of the present invention.

Figure 1:
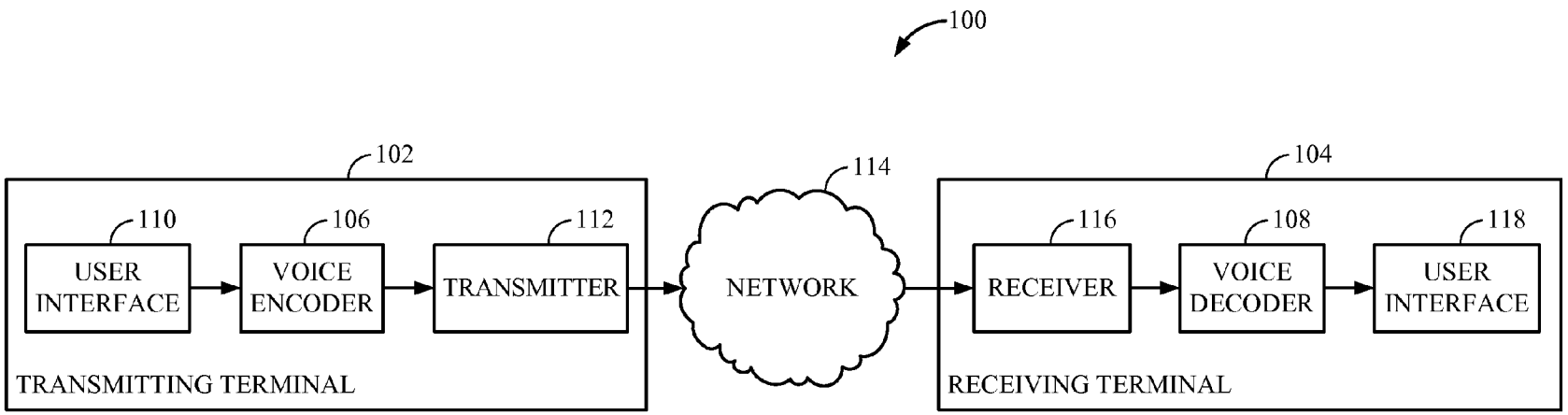
FIG. 1 is a conceptual block diagram illustrating an example of a transmitting terminal and receiving terminal over a transmission medium.

FIG. 1 is a conceptual block diagram illustrating an example of a transmitting terminal 102 and receiving terminal 104 over a transmission medium. The transmitting and receiving terminals 102, 104 may be any devices that are capable of supporting voice communications including phones, computers, audio broadcast and receiving equipment, video conferencing equipment, or the like. In one embodiment, the transmitting and receiving terminals 102, 104 are implemented with wireless Code Division Multiple Access (CDMA) capability, but may be implemented with any multiple access technology in practice. CDMA is a modulation and multiple access scheme based on spread-spectrum communications which is well known in the art.

The transmitting terminal 102 is shown with a voice encoder 106 and the receiving terminal 104 is shown with a voice decoder 108. The voice encoder 106 may be used to compress speech from a user interface 110 by extracting parameters based on a model of human speech generation. A transmitter 112 may be used to transmit packets containing these parameters across the transmission medium 114. The transmission medium 114 may be a packet-based network, such as the Internet or a corporate intranet, or any other transmission medium. A receiver 116 at the other end of the transmission medium 112 may be used to receive the packets. The voice decoder 108 synthesizes the speech using the parameters in the packets. The synthesized speech may then be provided to the user interface 118 on the receiving terminal 104. Although not shown, various signal processing functions may be performed in both the transmitter and receiver 112, 116 such as convolutional encoding including Cyclic Redundancy Check (CRC) functions, interleaving, digital modulation, and spread spectrum processing.

In most applications, each party to a communication transmits as well as receives. Each terminal would therefore require a voice encoder and decoder. The voice encoder and decoder may be separate devices or integrated into a single device known as a "vocoder." In the detailed description to follow, the terminals 102, 104 will be described with a voice encoder 106 at one end of the transmission medium 114 and a voice decoder 108 at the other. Those skilled in the art will readily recognize how to extend the concepts described herein to two-way communications.

In at least one embodiment of the transmitting terminal 102, speech may be input from the user interface 110 to the voice encoder 106 in frames, with each frame further partitioned into sub-frames. These arbitrary frame boundaries are commonly used where some block processing is performed, as is the case here. However, the speech samples need not be partitioned into frames (and sub-frames) if continuous processing rather than block processing is implemented. Those skilled in the art will readily recognize how block techniques described below may be extended to continuous processing. In the described embodiments, each packet transmitted across the transmission medium 114 may contain one or more frames depending on the specific application and the overall design constraints.

The voice encoder 106 may be a variable rate or fixed rate encoder. A variable rate encoder dynamically switches between multiple encoder modes from frame to frame, depending on the speech content. The voice decoder 108 also dynamically switches between corresponding decoder modes from frame to frame. A particular mode is chosen for each frame to achieve the lowest bit rate available while maintaining acceptable signal reproduction at the receiving terminal 104. By way of example, active speech may be encoded at full rate or half rate. Background noise is typically encoded at one-eighth rate. Both variable rate and fixed rate encoders are well known in the art.

The voice encoder 106 and decoder 108 may use Linear Predictive Coding (LPC). The basic idea behind LPC encoding is that speech may be modeled by a speech source (the vocal chords), which is characterized by its intensity and pitch. The speech from the vocal cords travels through the vocal tract (the throat and mouth), which is characterized by its resonances, which are called "formants." The LPC voice encoder 106 analyzes the speech by estimating the formants, removing their effects from the speech, and estimating the intensity and pitch of the residual speech. The LPC voice decoder 108 at the receiving end synthesizes the speech by reversing the process. In particular, the LPC voice decoder 108 uses the residual speech to create the speech source, uses the formants to create a filter (which represents the vocal tract), and runs the speech source through the filter to synthesize the speech.

Figure 2:
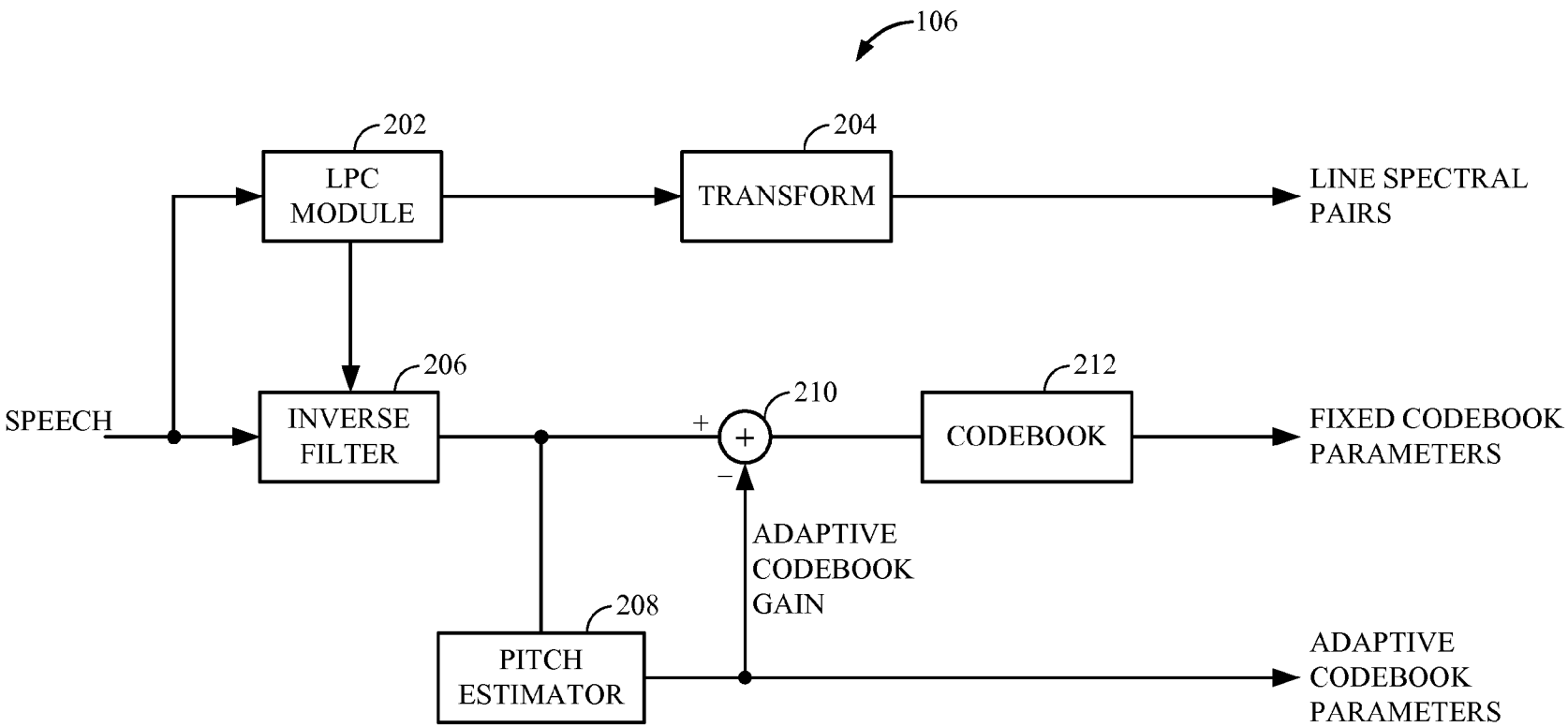
FIG. 2 is a conceptual block diagram illustrating an example of a voice encoder in a transmitting terminal.

FIG. 2 is a conceptual block diagram illustrating an example of a LPC voice encoder 106. The LPC voice encoder 106 includes a LPC module 202, which estimates the formants from the speech. The basic solution is a difference equation, which expresses each speech sample in a frame as a linear combination of previous speech samples (short term relation of speech samples). The coefficients of the difference equation characterize the formants, and the various methods for computing these coefficients are well known in the art. The LPC coefficients may be applied to an inverse filter 206, which removes the effects of the formants from the speech. The residual speech, along with the LPC coefficients, may be transmitted over the transmission medium so that the speech can be reconstructed at the receiving end. In at least one embodiment of the LPC voice encoder 106, the LPC coefficients are transformed 204 into Line Spectral Pairs (LSP) for better transmission and mathematical manipulation efficiency.

Further compression techniques may be used to dramatically decrease the information required to represent speech by eliminating redundant material. This may be achieved by exploiting the fact that there are certain fundamental frequencies caused by periodic vibration of the human vocal chords. These fundamental frequencies are often referred to as the "pitch." The pitch can be quantified by "adaptive codebook parameters" which include (1) the "delay" in the number of speech samples that maximizes the autocorrelation function of the speech segment, and (2) the "adaptive codebook gain." The adaptive codebook gain measures how strong the long-term periodicities of the speech are on a sub-frame basis. These long term periodicities may be subtracted 210 from the residual speech before transmission to the receiving terminal.

The residual speech from the subtractor 210 may be further encoded in any number of ways. One of the more common methods uses a codebook 212, which is created by the system designer. The codebook 212 is a table that assigns parameters to the most typical speech residual signals. In operation, the residual speech from the subtractor 210 is compared to all entries in the codebook 212. The parameters for the entry with the closest match are selected. The fixed codebook parameters include the "fixed codebook coefficients" and the "fixed codebook gain." The fixed codebook coefficients contain the new information (energy) for a frame. It basically is an encoded representation of the differences between frames. The fixed codebook gain represents the gain that the voice decoder 108 in the receiving terminal 104 should use for applying the new information (fixed codebook coefficients) to the current sub-frame of speech.

The pitch estimator 208 may also be used to generate an additional adaptive codebook parameter called "Delta Delay" or "DDelay." The DDelay is the difference in the measured delay between the current and previous frame. It has a limited range however, and may be set to zero if the difference in delay between the two frames overflows. This parameter is not used by the voice decoder 108 in the receiving terminal 104 to synthesize speech. Instead, it is used to compute the pitch of speech samples for lost or corrupted frames.

Figure 3:
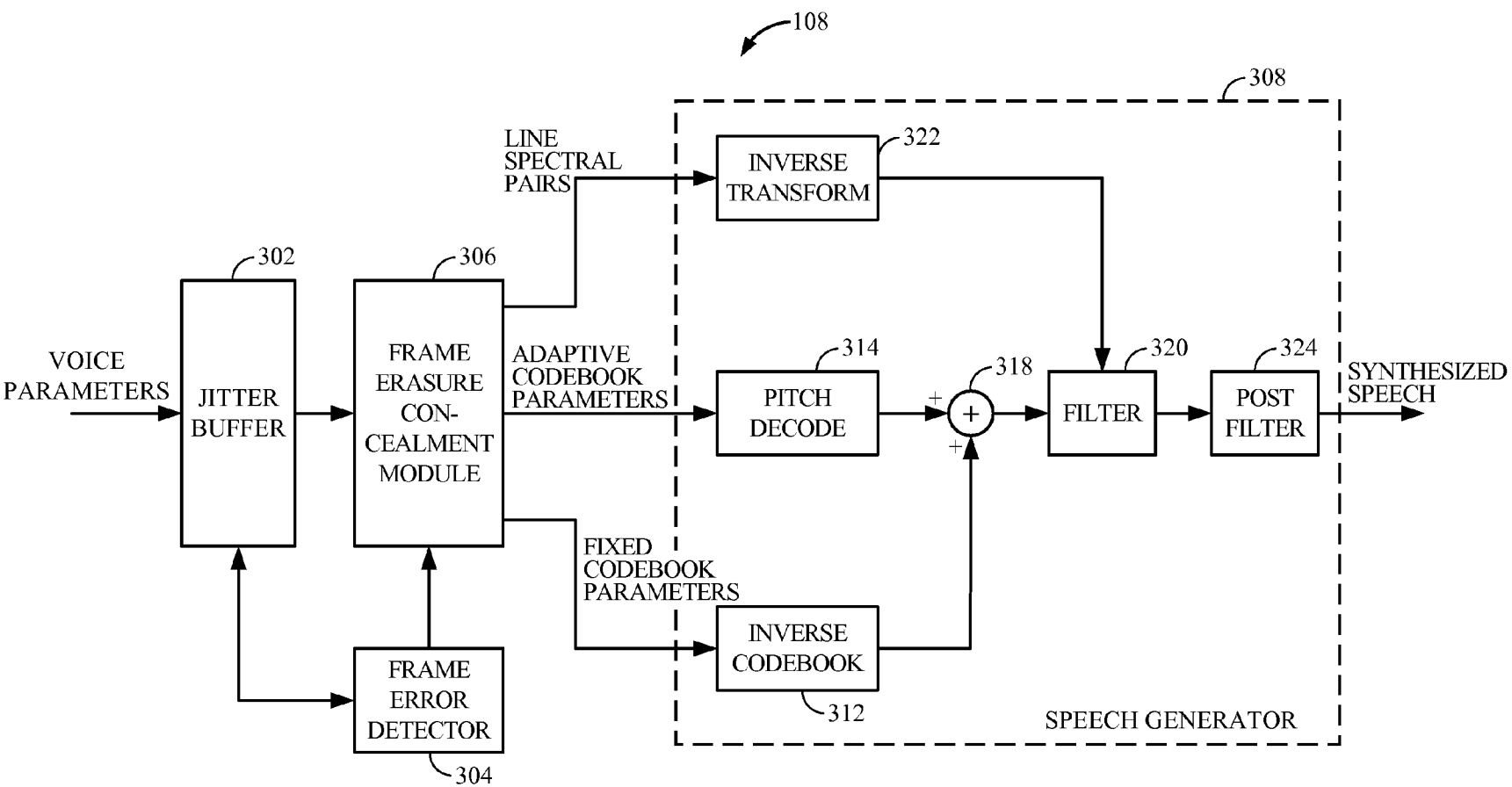
FIG. 3 is a more detailed conceptual block diagram of the receiving terminal shown in FIG. 1.

FIG. 3 is a more detailed conceptual block diagram of the receiving terminal 104 shown in FIG. 1. In this configuration, the voice decoder 108 includes a jitter buffer 302, a frame error detector 304, a frame erasure concealment module 306 and a speech generator 308. The voice decoder 108 may be implemented as part of a vocoder, as a stand-alone entity, or distributed across one or more entities within the receiving terminal 104. The voice decoder 108 may be implemented as hardware, firmware, software, or any combination thereof. By way of example, the voice decoder 108 may be implemented with a microprocessor, Digital Signal Processor (DSP), programmable logic, dedicated hardware or any other hardware and/or software based processing entity. The voice decoder 108 will be described below in terms of its functionality. The manner in which it is implemented will depend on the particular application and the design constraints imposed on the overall system. Those skilled in the art will recognize the interchangeability of hardware, firmware, and software configurations under these circumstances, and how best to implement the described functionality for each particular application.

The jitter buffer 302 may be positioned at the front end of the voice decoder 108. The jitter buffer 302 is a hardware device or software process that eliminates jitter caused by variations in packet arrival time due to network congestion, timing drift, and route changes. The jitter buffer 302 delays the arriving packets so that all the packets can be continuously provided to the speech generator 308, in the correct order, resulting in a clear connection with very little audio distortion. The jitter buffer 302 may be fixed or adaptive. A fixed jitter buffer introduces a fixed delay to the packets. An adaptive jitter buffer, on the other hand, adapts to changes in the network's delay. Both fixed and adaptive jitter buffers are well known in the art.

As discussed earlier in connection with FIG. 1, various signal processing functions may be performed by the transmitting terminal 102 such as convolutional encoding including CRC functions, interleaving, digital modulation, and spread spectrum processing. The frame error detector 304 may be used to perform the CRC check function. Alternatively, or in addition to, other frame error detection techniques may be used including a checksum and parity bit, just to name a few. In any event, the frame error detector 304 determines whether a frame erasure has occurred. A "frame erasure" means either that the frame was lost or corrupted. If the frame error detector 304 determines that the current frame has not been erased, the frame erasure concealment module 306 will release the voice parameters for that frame from the jitter buffer 302 to the speech generator 308. If, on the other hand, the frame error detector 304 determines that the current frame has been erased, it will provide a "frame erasure flag" to the frame erasure concealment module 306. In a manner to be described in greater detail later, the frame erasure concealment module 306 may be used to reconstruct the voice parameters for the erased frame.

The voice parameters, whether released from the jitter buffer 302 or reconstructed by the frame erasure concealment module 306, are provided to the speech generator 308. Specifically, an inverse codebook 312 is used to convert the fixed codebook coefficients to residual speech and apply the fixed codebook gain to that residual speech. Next, the pitch information is added 318 back into the residual speech. The pitch information is computed by a pitch decoder 314 from the "delay." The pitch decoder 314 is essentially a memory of the information that produced the previous frame of speech samples. The adaptive codebook gain is applied to the memory information in each sub-frame by the pitch decoder 314 before being added 318 to the residual speech. The residual speech is then run through a filter 320 using the LPC coefficient from the inverse transform 322 to add the formants to the speech. The raw synthesized speech may then be provided from the speech generator 308 to a post-filter 324. The post-filter 324 is a digital filter in the audio band that tends to smooth the speech and reduce out-of-band components.

The quality of the frame erasure concealment process improves with the accuracy in reconstructing the voice parameters. Greater accuracy in the reconstructed speech parameters may be achieved when the speech content of the frames is higher. This means that most voice quality gains through frame erasure concealment techniques are obtained when the voice encoder and decoder are operated at full rate (maximum speech content). Using half rate frames to reconstruct the voice parameters of a frame erasure provides some voice quality gains, but the gains are limited. Generally speaking, one-eight rate frames do not contain any speech content, and therefore, may not provide any voice quality gains. Accordingly, in at least one embodiment of the voice decoder 108, the voice parameters in a future frame may be used only when the frame rate is sufficiently high to achieve voice quality gains. By way of example, the voice decoder 108 may use the voice parameters in both the previous and future frame to reconstruct the voice parameters in an erased frame if both the previous and future frames are encoded at full or half rate. Otherwise, the voice parameters in the erased frame are reconstructed solely from the previous frame. This approach reduces the complexity of the frame erasure concealment process when there is a low likelihood of voice quality gains. A "rate decision" from the frame error detector 304 may be used to indicate the encoding mode for the previous and future frames of a frame erasure.

Figure 4:
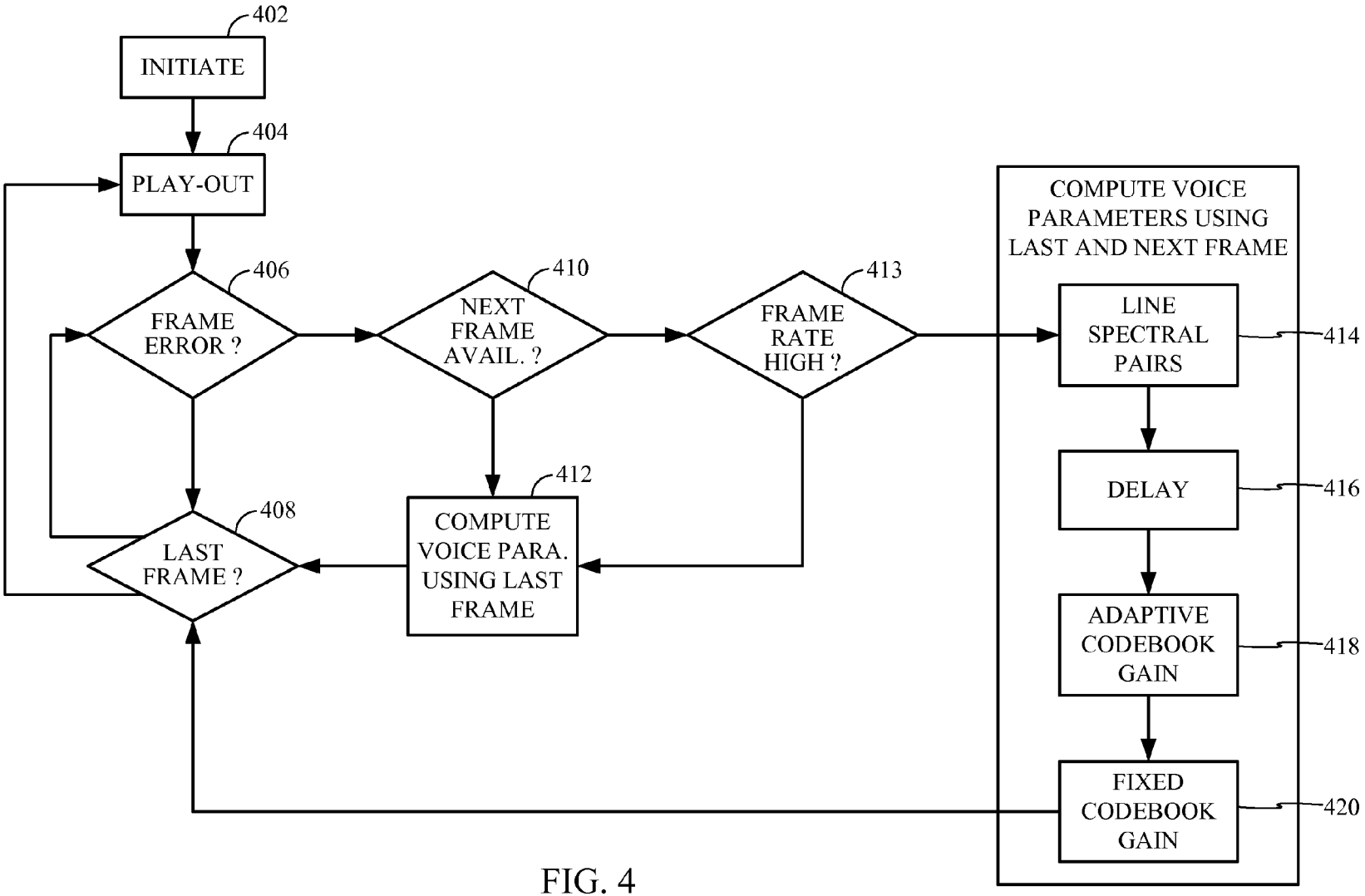
FIG. 4 is a flow diagram illustrating the functionality of a frame erasure concealment module in a voice decoder.

FIG. 4 is a flow diagram illustrating the operation of the frame erasure concealment module 306. The frame erasure concealment module 306 begins operation in step 402. Operation is typically initiated as part of the call set-up procedures between two terminals over the network. Once operational, the frame erasure concealment module 306 remains idle in step 404 until the first frame of a speech segment is released from the jitter buffer 302. When the first frame is released, the frame erasure concealment module 306 monitors the "frame erasure flag" from the frame error detector 304 in step 406. If the "frame erasure flag" is cleared, the frame erasure concealment module 306 waits for the next frame in step 408, and then repeats the process. On the other hand, if the "frame erasure flag" is set in step 406, then the frame erasure concealment module 306 will reconstruct the speech parameters for that frame.

The frame erasure concealment module 306 reconstructs the speech parameters for the frame by first determining whether information from future frames is available in the jitter buffer 302. In step 410, the frame erasure concealment module 306 makes this determination by monitoring a "future frame available flag" generated by the frame error detector 304. If the "future frame available flag" is cleared, then the frame erasure concealment module 306 must reconstruct the speech parameters from the previous frames in step 412, without the benefit of the information in future frames. On the other hand, if the "future frame available flag" is set, the frame erasure concealment module 306 may provide enhanced concealment by using information from both the previous and future frames. This process is performed however, only if the frame rate is high enough to achieve voice quality gains. The frame erasure concealment module 306 makes this determination in step 413. Either way, once the frame erasure concealment module 306 reconstructs the speech parameters for the current frame, it waits for the next frame in step 408, and then repeats the process.

In step 412, the frame erasure concealment module 306 reconstructs the speech parameters for the erased frame using the information from the previous frame. For the first frame erasure in a sequence of lost frames, the frame erasure concealment module 306 copies the LSPs and the "delay" from the last received frame, sets the adaptive codebook gain to the average gain over the sub-frames of the last received frame, and sets the fixed codebook gain to zero. The adaptive codebook gain is also faded and element of randomness is the LSPs and the "delay" if power (adaptive codebook gain) is low.

As indicated above, improved error concealment may be achieved when information from future frames is available and the frame rate is high. In step 414, the LSPs for a sequence of frame erasures may be linearly interpolated from the previous and future frames. In step 416, the delay may be computed using the DDelay from the future frame, and if the DDelay is zero, then the delay may be linearly interpolated from the previous and future frames. In step 418, the adaptive codebook gain may be computed. At least two different approaches may be used. The first approach computes the adaptive codebook gain in a similar manner to the LSPs and the "delay." That is, the adaptive codebook gain is linearly interpolated from the previous and future frames. The second approach sets the adaptive codebook gain to a high value if the "delay" is known, i.e., the DDelay for the future frame is not zero and the delay of the current frame is exact and not estimated. A very aggressive approach may be used by setting the adaptive codebook gain to one. Alternatively, the adaptive codebook gain may be set somewhere between one and the interpolation value between the previous and future frames. Either way, there is no fading of the adaptive codebook gain as might be experienced if information from future frames is not available. This is only possible because having information from the future tells the frame erasure concealment module 306 whether the erased frames have any speech content (the user may have stopped speaking just prior to the transmission of the erased frames). Finally, in step 420, the fixed codebook gain is set to zero.

The various illustrative logical blocks, modules, circuits, elements, and/or components described in connection with the embodiments disclosed herein may be implemented or performed with a general purpose processor, a Digital Signal Processor (DSP), an Application Specific Integrated Circuit (ASIC), a Field Programmable Gate Array (FPGA) or other programmable logic component, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing components, e.g., a combination of a DSP and a microprocessor, a plurality of microprocessors, one or more microprocessors in conjunction with a DSP core, or any other such configuration.

The methods or algorithms described in connection with the embodiments disclosed herein may be embodied directly in hardware, in a software module executed by a processor, or in a combination of the two. A software module may reside in Random Access Memory (RAM) flash memory, Read Only Memory (ROM), Electrically Programmable ROM (EPROM), Electrically Erasable Programmable ROM (EEPROM), registers, hard disk, a removable disk, a CD-ROM, or any other form of storage medium known in the art. A storage medium may be coupled to the processor such that the processor can read information from, and write information to, the storage medium. In the alternative, the storage medium may be integral to the processor.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A voice decoder, comprising:

a speech generator configured to receive a sequence of frames, each of the frames having voice parameters, and generate speech from the voice parameters; and a frame erasure concealment module configured to reconstruct the voice parameters for a frame erasure in the sequence of frames from the voice parameters in one or more previous frames and voice parameters in one or more subsequent frames.

2. The voice decoder of claim 1 wherein the frame erasure concealment module is further configured to reconstruct the voice parameters for the frame erasure from the voice parameters in a plurality of the previous frames including said one of the previous frames and the voice parameters from a plurality of the subsequent frames including said one of the subsequent frames.

3. The voice decoder of claim 1 wherein the frame erasure concealment module is configured to reconstruct the voice parameters for a frame erasure in the sequence of frames from the voice parameters in said one of the previous frames and the voice parameters in said one of the subsequent frames in response to a determination that the frame rates from said one of the previous frames and said one of the future frames are above a threshold.

4. The voice decoder of claim 1 further comprising a jitter buffer configured to provide the frames to the speech generator in a correct sequence.

5. The voice decoder of claim 4 wherein the jitter buffer is further configured to provide the voice parameters from said one or more of the previous frames and the voice parameters from said one or more of the subsequent frames to the frame erasure concealment module to reconstruct the voice parameters for the frame erasure.

6. The voice decoder of claim 1 further comprising a frame error detector configured to detect the frame erasure.

7. The voice decoder of claim 1 wherein the voice parameters in each of the frames includes a line spectral pair, and wherein the frame erasure concealment module is further configured to reconstruct the line spectral pair for the erased frame by interpolating between the line spectral pair in said one of the previous frames and the line spectral pair in said one of the subsequent frames.

8. The voice decoder of claim 1 wherein the voice parameters in each of the frames includes a delay and a difference value, the difference value indicating a difference between the delay and a delay of a most recent previous frame, and wherein the frame erasure concealment module is further configured to reconstruct the delay for the erased frame from the difference value in said one of the subsequent frames if said one of the subsequent frames is the next frame and the frame erasure concealment module determines that the difference value in said one of the subsequent frames is within a range.

9. The voice decoder of claim 8 wherein the frame erasure concealment module is further configured to reconstruct the delay for the erased frame by interpolating between the delay in said one of the previous frames and the delay in said one of the subsequent frames if said one of the subsequent frames is not the next frame.

10. The voice decoder of claim 8 wherein the frame erasure concealment module is further configured to reconstruct the delay for the erased frame by interpolating between the delay in said one of the previous frames and the delay in said one of the subsequent frames if the frame erasure concealment module determines that the delay value in said one of the subsequent frames is outside the range.

11. The voice decoder of claim 1 wherein the voice parameters in each of the frames includes an adaptive codebook gain, and wherein the frame erasure concealment module is further configured to reconstruct the adaptive codebook gain for the erased frame by interpolating between the adaptive codebook gain in said one of the previous and the adaptive codebook gain in said one of the subsequent frames.

12. The voice decoder of claim 1 wherein the voice parameters in each of the frames include an adaptive codebook gain, a delay, and a difference value, the difference value indicating the difference between the delay and the delay of the most recent previous frame, and frame erasure concealment module is further configured to reconstruct the adaptive codebook gain for the erased frame by setting the adaptive codebook gain to a value if the delay for the erased frame can be determined from the difference value in said one of the subsequent frames, the value being greater than an interpolated adaptive codebook gain between said one of the previous and said one of the subsequent frames.

13. The voice decoder of claim 1 wherein the voice parameters in each of the frames includes fixed codebook gain, and wherein the frame erasure concealment module is further configured to reconstruct the voice parameters for the erased frame by setting the fixed codebook gain for the erased frame to zero.

14. A method of decoding voice, comprising:

receiving a sequence of frames, each of the frames having voice parameters;

reconstructing the voice parameters for a frame erasure in the sequence of frames from the voice parameters in at least one previous frame and the voice parameters from at least one subsequent frames; and generating speech from the voice parameters in the sequence of frames.

15. The method of claim 14 wherein the voice parameters for the frame erasure are reconstructed from the voice parameters in a plurality of the previous frames including said one of the previous frames and the voice parameters in a plurality of the subsequent frames including said one of the subsequent frames.

16. The method of claim 14 further comprising determining that the frame rates from said one of the previous frames and said one of the future frames are above a threshold, and reconstructing the voice parameters for a frame erasure in the sequence of frames from the voice parameters from said one of the previous frames and the voice parameters from said one of the subsequent frames in response to such determination.

17. The method of claim 14 further comprising reordering the frames such that they are received in a correct sequence.

18. The method of claim 14 further comprising detecting the frame erasure.

19. The method of claim 14 wherein the voice parameters in each of the frames includes a line spectral pair, and wherein the line spectral pair for the erased frame is reconstructed by interpolating between the line spectral pair in said one of the previous frames and the line spectral pair in said one of the subsequent frames.

20. The method of claim 14 wherein said one of the subsequent frames is the next frame following the erased frame, and wherein the voice parameters in each of the frames includes a delay and a difference value, the difference value indicating a difference between the delay and a delay of a most recent previous frame, and wherein the delay for the erased frame is reconstructed from the difference value in said one of the subsequent frames in response to a determination that the difference value in said one of the subsequent frames is within a range.

21. The method of claim 14 wherein said one of the subsequent frames is not the next frame following the erased frame, and wherein the voice parameters in each of the frames includes a delay, and wherein the delay for the erased frame is reconstructed by interpolating between the delay in said one of the previous frames and the delay in said one of the subsequent frames.

22. The method of claim 14 wherein the voice parameters in each of the frames includes an adaptive codebook gain, and wherein the adaptive codebook gain for the erased frame is reconstructed by interpolating between the adaptive codebook gain in said one of the previous and the adaptive codebook gain in said one of the subsequent frames.

23. The method of claim 14 wherein the voice parameters in each of the frames includes an adaptive codebook gain, a delay, a difference value, the difference value indicating the difference between the delay and the delay of the most recent previous frame, and wherein the adaptive codebook gain for the erased frame is reconstructed by setting the adaptive codebook gain to a value if the delay for the erased frame can be determined from the difference value in said one of the subsequent frames, the value being greater than an interpolated adaptive codebook gain between said one of the previous and said one of the subsequent frames.

24. The method of claim 14 wherein the voice parameters in each of the frames includes fixed codebook gain, and wherein the voice parameters for the erased frame is reconstructed by setting the fixed codebook gain for the erased frame to zero.

25. A voice decoder configured to receive a sequence of frames, each of the frames having voice parameters, the voice decoder comprising:

means for generating speech from the voice parameters; and means for reconstructing the voice parameters for a frame erasure in the sequence of frames from the voice parameters in at least one previous frame and the voice parameters in at least one subsequent frame.

26. The voice decoder of claim 25 further comprising means for providing the frames to the speech generation means in the correct sequence.

27. A communications terminal, comprising:

a receiver; and a voice decoder configured to receive a sequence of frames from the receiver, each of the frames having voice parameters, the voice decoder comprising a speech generator configured to generate speech from the voice parameters, and a frame erasure concealment module configured to reconstruct the voice parameters for a frame erasure in the sequence of frames from voice parameters in one or more previous frames and the voice parameters in one or more subsequent frames.

28. The communications terminal of claim 27 wherein the frame erasure concealment module is configured to reconstruct the voice parameters for a frame erasure in the sequence of frames from the voice parameters in said one of the previous frames and the voice parameters in said one of the subsequent frames in response to a determination that the frame rates from said one of the previous frames and said one of the future frames is above a threshold.

29. The communications terminal of claim 27 wherein the voice decoder further comprises a jitter buffer configured to provide the frames from the receiver to the speech generator in the correct sequence.

30. The communications terminal of claim 29 wherein the jitter buffer is further configured to provide the voice parameters from said one of the previous frames and the voice parameters from said one of the subsequent frames to the frame erasure concealment module to reconstruct the voice parameters for the frame erasure.

31. The communications terminal of claim 27 wherein the voice decoder further comprises a frame error detector configured to detect the frame erasure.

32. The communications terminal of claim 27 wherein the voice parameters in each of the frames includes a line spectral pair, and wherein the frame erasure concealment module is further configured to reconstruct the line spectral pair for the erased frame by interpolating between the line spectral pair in said one of the previous frames and the line spectral pair in said one of the subsequent frames.

33. The communications terminal of claim 27 wherein the voice parameters in each of the frames includes a delay and a difference value, the difference value indicating the difference between the delay and the delay of the most recent previous frame, and wherein the frame erasure concealment module is further configured to reconstruct the delay for the erased frame from the difference value in said one of the subsequent frames if said one of the subsequent frames is the next frame and the frame erasure concealment module determines that the difference value in said one of the subsequent frames within a range.

34. The communications terminal of claim 33 wherein the frame erasure concealment module is further configured to reconstruct the delay for the erased frame by interpolating between the delay in said one of the previous frames and the delay in said one of the subsequent frames if said one of the subsequent frames is not the next frame.

35. The communications terminal of claim 33 wherein the frame erasure concealment module is further configured to reconstruct the delay for the erased frame by interpolating between the delay in said one of the previous frames and the delay in said one of the subsequent frames if the frame erasure concealment module determines that the delay value in said one of the subsequent frames is outside the range.

36. The communications terminal of claim 27 wherein the voice parameters in each of the frames includes an adaptive codebook gain, and wherein the frame erasure concealment module is further configured to reconstruct the adaptive codebook gain for the erased frame by interpolating between the adaptive codebook gain in said one of the previous and the adaptive codebook gain in said one of the subsequent frames.

37. The communications terminal of claim 27 wherein the voice parameters in each of the frames includes an adaptive codebook gain, a delay, a difference value, the difference value indicating the difference between the delay and the delay of the most recent previous frame, and wherein the frame erasure concealment module is further configured to reconstruct the adaptive codebook gain for the erased frame by setting the adaptive codebook gain to a value if the delay for the erased frame can be determined from the difference value in said one of the subsequent frames, the value being greater than an interpolated adaptive codebook gain between said one of the previous and said one of the subsequent frames.

38. The communications terminal of claim 27 wherein the voice parameters in each of the frames includes fixed codebook gain, and wherein the frame erasure concealment module is further configured to reconstruct the voice parameters for the erased frame by setting the fixed codebook gain for the erased frame to zero.

39. A computer-readable medium comprising instructions that upon execution in a processor cause the processor to:

receive a sequence of frames, each of the frames having voice parameters;

reconstruct the voice parameters for a frame erasure in the sequence of frames from the voice parameters in at least one previous frame and the voice parameters from at least one of subsequent frames; and generate speech from the voice parameters in the sequence of frames.

40. The computer-readable medium of claim 39 wherein the voice parameters for the frame erasure are reconstructed from the voice parameters in a plurality of the previous frames including said one of the previous frames and the voice parameters in a plurality of the subsequent frames including said one of the subsequent frames.

41. The computer-readable medium of claim 39 further comprising instructions that upon execution in a processor cause the processor to determine that the frame rates from said one of the previous frames and said one of the future frames are above a threshold, and reconstruct the voice parameters for a frame erasure in the sequence of frames from the voice parameters from said one of the previous frames and the voice parameters from said one of the subsequent frames in response to such determination.

42. The computer-readable medium of claim 39 further comprising instructions that upon execution in a processor cause the processor to reorder the frames such that they are received in a correct sequence.

43. The computer-readable medium of claim 39 further comprising instructions that upon execution in a processor cause the processor to detect the frame erasure.

44. The computer-readable medium of claim 39 wherein the voice parameters in each of the frames includes a line spectral pair, and wherein the line spectral pair for the erased frame is reconstructed by interpolating between the line spectral pair in said one of the previous frames and the line spectral pair in said one of the subsequent frames.

45. The computer-readable medium of claim 39 wherein said one of the subsequent frames is the next frame following the erased frame, and wherein the voice parameters in each of the frames includes a delay and a difference value, the difference value indicating a difference between the delay and a delay of a most recent previous frame, and wherein the delay for the erased frame is reconstructed from the difference value in said one of the subsequent frames in response to a determination that the difference value in said one of the subsequent frames is within a range.

46. The computer-readable medium of claim 39 wherein said one of the subsequent frames is not the next frame following the erased frame, and wherein the voice parameters in each of the frames includes a delay, and wherein the delay for the erased frame is reconstructed by interpolating between the delay in said one of the previous frames and the delay in said one of the subsequent frames.

47. The computer-readable medium of claim 39 wherein the voice parameters in each of the frames includes an adaptive codebook gain, and wherein the adaptive codebook gain for the erased frame is reconstructed by interpolating between the adaptive codebook gain in said one of the previous and the adaptive codebook gain in said one of the subsequent frames.

48. The computer-readable medium of claim 39 wherein the voice parameters in each of the frames includes an adaptive codebook gain, a delay, a difference value, the difference value indicating the difference between the delay and the delay of the most recent previous frame, and wherein the adaptive codebook gain for the erased frame is reconstructed by setting the adaptive codebook gain to a value if the delay for the erased frame can be determined from the difference value in said one of the subsequent frames, the value being greater than an interpolated adaptive codebook gain between said one of the previous and said one of the subsequent frames.

49. The computer-readable medium of claim 39 wherein the voice parameters in each of the frames includes fixed codebook gain, and wherein the voice parameters for the erased frame is reconstructed by setting the fixed codebook gain for the erased frame to zero.

* * * * *